United States Patent [19]

Higashio et al.

[11] Patent Number: 4,914,486

[45] Date of Patent: Apr. 3, 1990

[54] IMAGE FORMING APPARATUS HAVING SIMULTANEOUS MULTICOLOR COPYING MODE

[75] Inventors: Kimihiko Higashio; Masazumi Ito, both of Osaka, Japan

[73] Assignee: Minolta Camera Kabushiki Kaisha, Osaka, Japan

[21] Appl. No.: 298,113

[22] Filed: Jan. 18, 1989

[30] Foreign Application Priority Data

Jan. 19, 1988 [JP] Japan ..... 63-10192

[51] Int. Cl.[4] ..... G03G 15/01

[52] U.S. Cl. ..... 355/326; 355/314

[58] Field of Search ..... 355/210, 218, 326, 314

[56] References Cited

U.S. PATENT DOCUMENTS

| | | | |
|---|---|---|---|
| 2,910,963 | 11/1959 | Herman . | |
| 3,572,288 | 8/1968 | Turner . | |
| 3,914,043 | 10/1975 | McVeigh . | |
| 3,960,445 | 6/1976 | Drawe . | |
| 3,967,891 | 7/1976 | Rippstein . | |
| 4,099,860 | 7/1978 | Connin . | |
| 4,162,848 | 7/1979 | Platt | 355/314 |
| 4,273,439 | 6/1981 | Markham et al. | 355/314 |
| 4,315,685 | 2/1982 | Inuzuka et al. | 355/314 X |
| 4,344,697 | 8/1982 | Matsumoto et al. | 355/314 |
| 4,346,982 | 8/1982 | Nakajima et al. . | |
| 4,373,798 | 2/1983 | Tsukada et al. . | |
| 4,572,102 | 2/1986 | Yuge et al. . | |
| 4,579,443 | 4/1986 | Abuyama et al. . | |
| 4,619,514 | 10/1986 | Ide . | |
| 4,627,707 | 12/1986 | Tani et al. . | |
| 4,630,128 | 12/1986 | Gokita | 355/314 X |
| 4,634,259 | 1/1987 | Oishi et al. . | |
| 4,641,602 | 2/1987 | Kasai . | |
| 4,657,376 | 4/1987 | Ide . | |
| 4,659,211 | 4/1987 | Oka . | |
| 4,666,288 | 5/1987 | Watanabe . | |
| 4,678,316 | 7/1987 | Abuyama | 355/314 |
| 4,685,794 | 8/1987 | Watanabe . | |
| 4,690,543 | 9/1987 | Watanabe . | |
| 4,710,016 | 12/1987 | Watanabe . | |
| 4,711,556 | 12/1987 | Abuyama | 355/314 X |
| 4,720,730 | 1/1988 | Ito . | |
| 4,723,148 | 2/1988 | Hamakawa . | |
| 4,728,985 | 3/1988 | Nakashima et al. . | |
| 4,740,811 | 4/1988 | Watanabe . | |
| 4,743,945 | 5/1988 | Ito et al. . | |
| 4,743,946 | 5/1988 | Nishimori et al. . | |
| 4,745,437 | 5/1988 | Oka et al. . | |
| 4,746,954 | 5/1988 | Matuura et al. . | |
| 4,754,301 | 6/1988 | Kasamura et al. . | |
| 4,772,921 | 9/1988 | Ito . | |

FOREIGN PATENT DOCUMENTS

| | | |
|---|---|---|
| 3705511 | 9/1987 | Fed. Rep. of Germany . |
| 48-22212 | 7/1973 | Japan . |
| 51-134635 | 11/1976 | Japan . |
| 54-30833 | 3/1979 | Japan . |
| 60-170808 | 9/1985 | Japan . |
| 60-212778 | 10/1985 | Japan . |
| 61-72270 | 4/1986 | Japan . |
| 61-203474 | 9/1986 | Japan . |

*Primary Examiner*—R. L. Moses

*Attorney, Agent, or Firm*—Burns, Doane, Swecker & Mathis

[57] ABSTRACT

The present invention is directed to an image forming apparatus comprising, a copying machine including a plurality of developing units, and having a simultaneous multicolor copying mode for obtaining a multicolor copy by switching developing colors during one scanning operation, and an interrupt function for effecting interrupt copying, whereby when the simultaneous multicolor copying mode is executed, the interrupt copying is prohibited to prevent miscopying caused by interrupt copying at the simultaneous multicolor copying.

4 Claims, 11 Drawing Sheets

IMAGE FORMING APPARATUS HAVING SIMULTANEOUS MULTICOLOR COPYING MODE

BACKGROUND OF THE INVENTION

1. Field of the Invention

The present invention relates to an image forming apparatus such as a copying machine and the like, particularly, it relates to an image forming apparatus including a simultaneous multicolor copying mode.

2. Description of Related Art

In an image forming apparatus such as an electrophotographic copying machine, there is an apparatus in which a plurality of developing units are disposed and developing colors are switched during one scanning operation to obtain a multicolor copy. When copying is performed in the simultaneous multicolor copy mode, developing colors and switching positions are designated in advance. In the simultaneous multicolor copy mode, respective developing units are operated according to the designation so as to obtain the multicolor copy by one scanning (refer to the U.S. patent application Ser. No. 148,423).

While, some copying machines are provided with an interrupt copying function. When interrupt copying is designated, the present copying mode is stored and shunted and the other copying mode can be used. Thereafter, the copying mode shunted is restored and copying in the original copying mode can be continued.

As a designating method for the developing color switching position in the simultaneous multicolor copy, for example, by a position designating lever provided slidably near a document glass platen, the lever position is designated in the sliding direction and detected to switch the developing colors.

Now, in a copying machine in which both the simultaneous multicolor copying and interrupt copying are possible, there is the possibility that simultaneous multicolor copying is interrupted. In this case, the developing color switching position may be changed at interrupt copying. For example, such as a case wherein the lever position has been moved to a desired position without releasing designation of the simultaneous multicolor copy at the interrupt copying. In this case, when returning to the simultaneous multicolor copy mode from the interrupt copying, it is difficult to return to the original lever position, so that there is the possibility of causing miscopying.

In order to solve this problem, though the switching position can be stored and returned automatically to the original position at completion of interruption, it requires a large-scaled apparatus.

SUMMARY OF THE INVENTION

The present invention has been devised to solve problems aforementioned, therefore, it is an object thereof to provide an image forming apparatus in which, by prohibiting interrupt copying when a simultaneous multicolor copy mode is selected, miscopying caused by interrupt copying in the simultaneous multicolor copy mode is prevented.

The above and further objects and features of the invention will more fully be apparent from the following detailed description with accompanying drawings.

DESCRIPTION OF THE PREFERRED EMBODIMENTS

In the following, one embodiment of the present invention will be explained with reference to the accompanying drawings.

(a) Configuration of a Copying Machine

Figure 1:
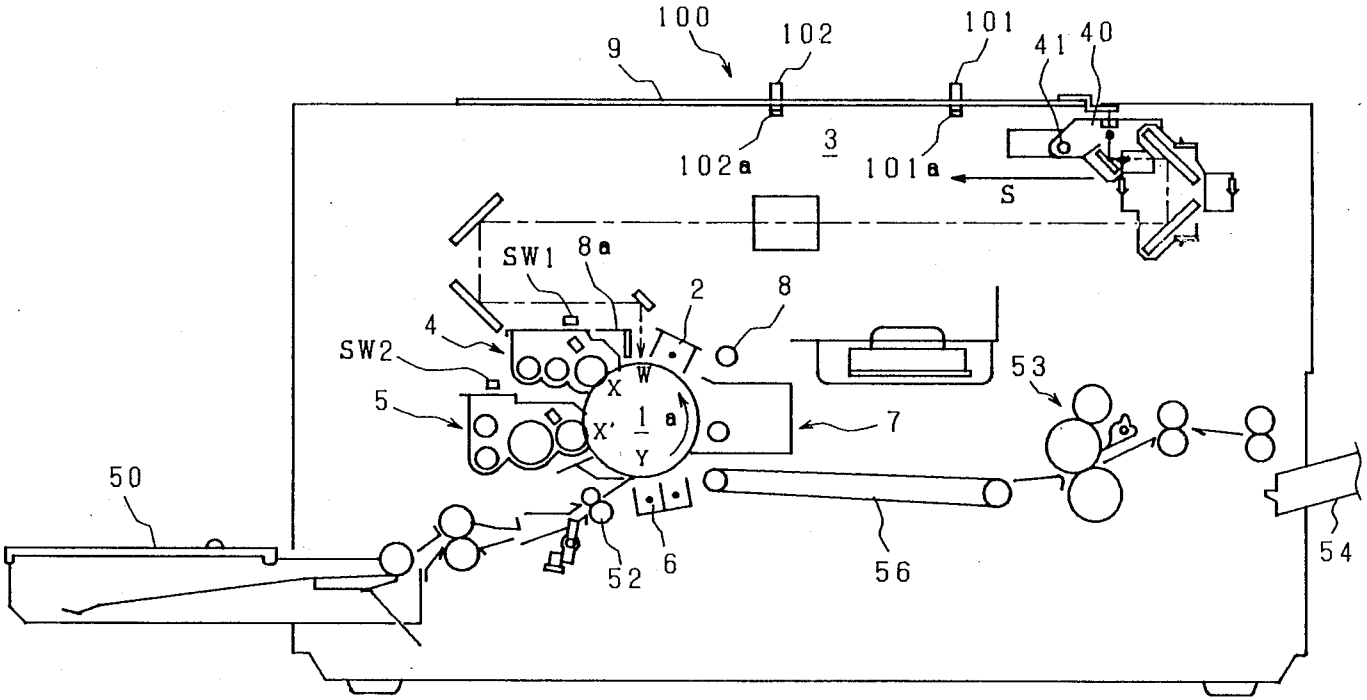
FIG. 1 is a schematic sectional view of a simultaneous two-color copying machine of the present invention.

FIG. 1 is a schematic sectional view of a simultaneous two-color copying machine which is one of an image forming apparatus.

The schematic configuration will be explained together with normal copying operation which reproduces a document image as it is.

First, in the state where a photosensitive drum (1) is rotating counter-clockwise, a fixed electric charge is applied to its surface by discharge of a charger (2).

Next, a scanner (40) having an exposure lamp (41) of an optical system (3) irradiates light on a document placed on a document glass platen (9) as scanning in the arrow (S) direction, and the reflected light is exposed on the photosensitive drum (1) from an exposure point (W) via mirrors and a lens to form an electrostatic latent image corresponding to the document image.

Then, end portions and interimage portions are discharged by an intermediate eraser **(8*a*)** consisting of a row of LED group.

The electrostatic latent image is developed into an actual image at a developing area (X) or (X') opposing to a first developing unit (4) or a second developing unit (5) and the document image is reproduced into a toner image.

While, paper to be copied is fed selectively from a paper feeder (50), transported by a timing roller pair (52) to a portion "transfer area (Y)" opposing to a transfer charger (6) in synchronism with the toner image on the photosensitive drum (1), and the toner image is transferred thereon. Then, the copied paper is transported between a fixing roller pair (53) by a conveyer belt (56) and discharged into a discharge tray (54) with the toner image being melted and fixed thereon.

Residual toner on the photosensitive drum (1) is scraped off by a cleaning device (7), and furthermore, remained electric charge is erased by irradiation of an eraser lamp (8) for next developing.

In the copying machine executing aforesaid operations, in addition to the normal copying aforementioned, simultaneous two-color operation for obtaining a two-color composite copy can be effected by one scanning operation of the scanner (40), for this purpose, the developing units (4),(5) are respectively provided with a special mechanism, and at the same time, image edition is effected on the operation panel to be described later (refer to FIG. 6 (300)). Also, a well-known external image editing unit may by connected. The first and second developing units (4),(5) are respectively detachable at respective positions shown in FIG. 2, which is detectable by switches (SW1)(SW2). While, on the upper surface of the first and second developing units (4),(5), magnets (not shown) are secured. Positions of the magnets are detected by reed switches (SW3) through (SW8) (not shown) on the main body of the copying machine to destinguish colors of respective toners contained in the first and second developing units (4),(5).

Figure 2:
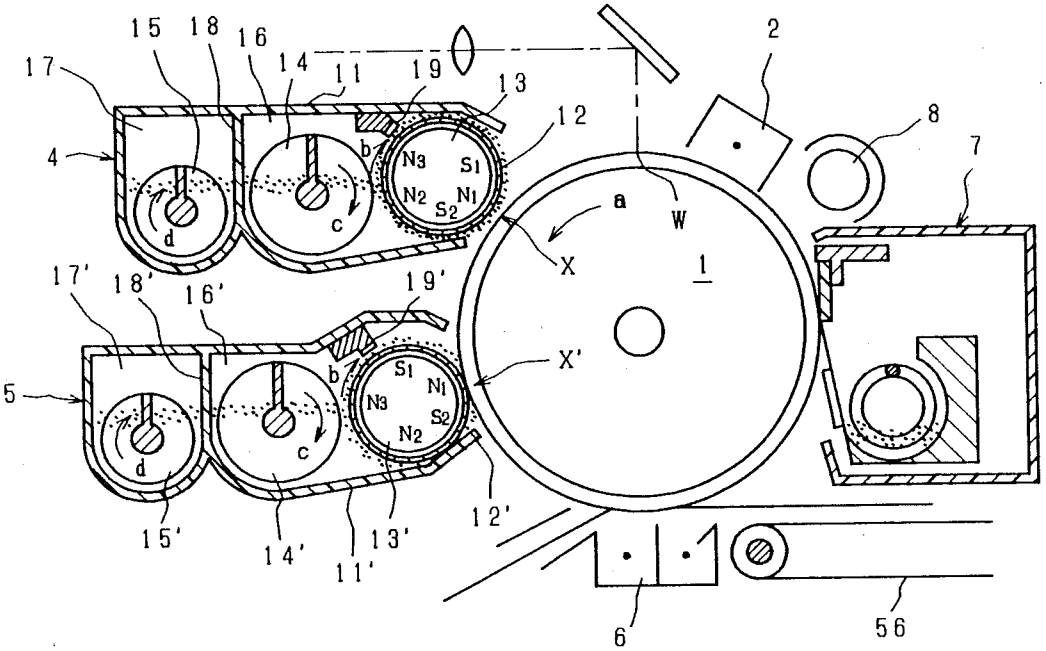
FIG. 2 is a sectional view near a photosensitive drum of a copying machine.
Figure 3:
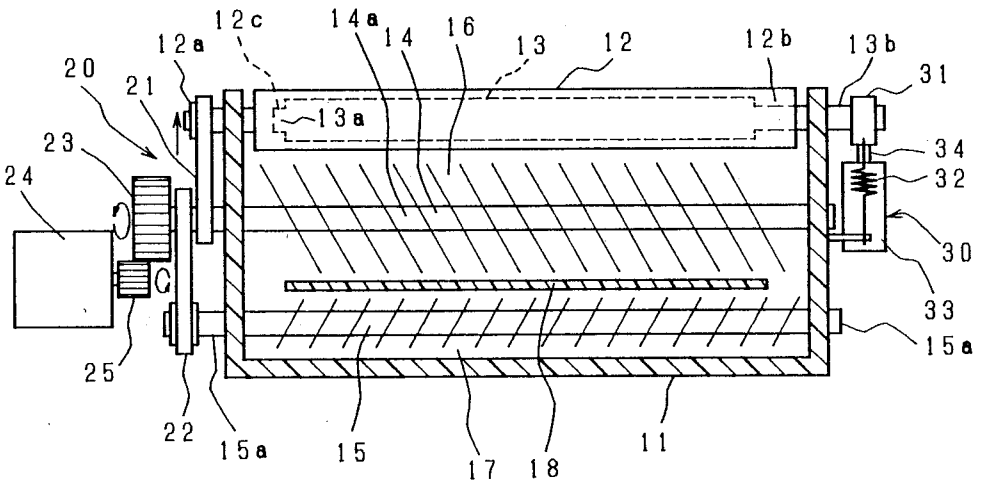
FIG. 3 is a transverse sectional view of a developing unit.

First, configurations of the first and second developing units (4),(5) will be explained. FIG. 2 is a sectional view near a photosensitive drum of a copying machine, and FIG. 3 is a transverse sectional view of a developing unit. The first and second developing units (4),(5) are constructed almost similarly as shown in FIG. 2 (reference characters on respective parts of the second developing unit (5) are indicated by putting a dash to the reference characters of corresponding parts of the first developing unit (4)). Now, assuming that in the first developing unit (4), a developer composing of a magnetic carrier and an insulated color toner (toners other than a black toner) is contained, and in the second developing unit (5), a developer composing of the magnetic carrier and the insulated black toner used usually is contained. Referring now to the first developing unit (4), in a developing tank (11), a developing sleeve (12), supply roller (14) and screw (15) are disposed successively from the photosensitive drum (1) side.

The developing sleeve (12) is made by forming a nonmagnetic conductive material cylindrically and its periphery is sandblasted to form fine unevenness. On the rear side of the developing area (X) of the developing sleeve (12), a developer height restricting member (19) is provided on the inner upper portion of the developing tank (11).

The supply roller (14) and screw roller (15) are disposed respectively in transport passages (16),(17) partitioned by a partition (18).

The transport passages (16),(17) are in communication with each other at both sides of the developing tank (11) as shown in FIG. 3.

As shown in FIG. 3 by driving gears (25,23) and belts (21),(22) by a motor (24) to rotate support shafts (12*a*, 14*a*, 15*a*), the developing screw (12), supply roller (14) and screw (15) are rotated respectively in the arrow directions (b, c, d) in FIG. 2. According to the rotation, the toner is sent toward the developing sleeve (12) via the screw (15) and the supply roller (14), and directed further to the developing area (X) through the gap between the developing sleeve (12) and the developer height restricting member (19).

While, in the developing sleeve (12), magnet roller (13) provided with a plurality of magnets (N1, N2, N3, S1, S2) disposed axially is incorporated (where, N, S indicate polarities of the magnet).

As shown in FIG. 3, the magnet roller (13) is supported by a recessed bearing (12*a*) provided in the developing sleeve (12) at one end (13*a*) of its support shaft, and by a side wall of the developing tank (11) at the other end (13*b*) thereof. The support shaft (13*b*) supports the center portion of a lever (31) outside the side wall. One end of the lever (31) is energized by a spring (32). To the other end of the lever (31), a plunger (34) of a solenoid (33) is engaged to rotate the lever (31) against the biasing force of the spring (32), and the magnet roller (13) by a predetermined angle when the solenoid (33) is driven. Referring again to FIG. 2, assuming that the first developing unit (4) is now in the state wherein the solenoid (33) is operated and the motor (24) is not driven, in this state, the screw (15), supply roller (14) and developing sleeve (12) are in standstill and the toner is not supplied. Moreover, the magnet (N3) is opposing to the developer height restricting member (19), and the developing area (X) opposes to the midway portion of the magnets (N1) and (S1). The toner on the developing sleeve (12) is thick on the magnets (N1 through N3, S1, S2) and thin at the midway portions between respective magnets by distribution of lines of magnetic force. Accordingly, the gap between the developing sleeve (12) and the developer height restricting member (19) is closed by the toner, and on the surface opposing to the developing area (X), the toner is thin and does not stick to the photosensitive drum (1).

In FIG. 2, assuming that the second developing unit (5) is in the state wherein the solenoid (33') is not operated and the motor (24') is driven, in this state, the screw (15'), supply roller (14') and developing screw (12') are rotated and the toner is supplied. The developer height restricting member (19') opposes the midway portion of the magnets (N3, S1), the gap is opened and the toner is transported to the developing area (X'). The developing area (X') opposes to the magnet (N1), above which the toner on the developing sleeve (12) is thick and easy to stick to the photosensitive drum (1).

(b) Image Editing Mechanism

Figure 4:
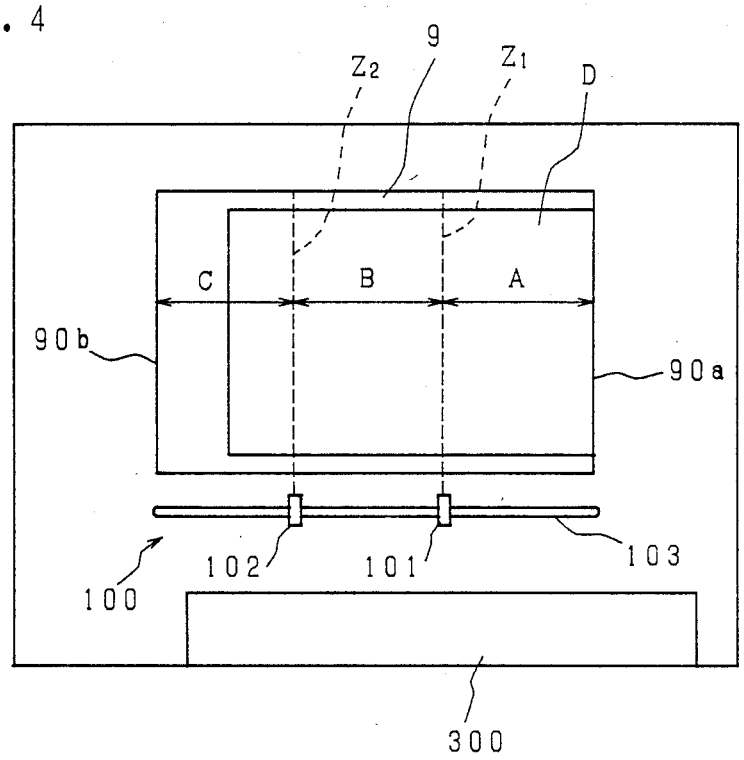
FIG. 4 is a top view of a copying machine.
Figure 5:
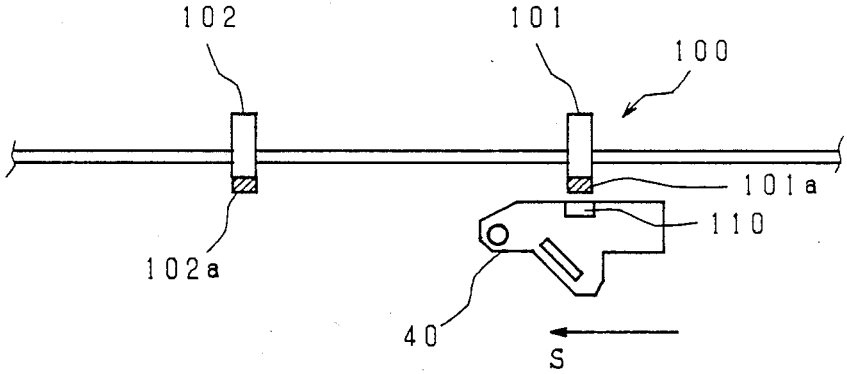
FIG. 5 is a view showing an image editing mechanism.

Now, an image editing mechanism (100) will be explained. FIG. 4 is a top view of a copying machine and FIG. 5 is a view showing the configuration of the image editing mechanism. The image editing mechanism (100) is designed to divide the document placing surface, which is the surface of the document glass platen (9) in the moving direction (in the arrow (S) direction) of the scanner (40) to designate areas as well as developing colors for every areas. First and second levers (101),(102) of the image editing mechanism (100) are mounted slidably to a guide groove (103) formed on the side of the document glass platen (9) along the scanning direction (S) of the scanner (40). At portions under the levers (101),(102) and positioned in the copying machine body, magnets (101*a*), (102*a*) are installed respectively. As shown in FIG. 4, in the state wherein the positions of respective levers (101),(102) are set, areas are designated as such that, an area (A) extends from the front edge portion (90*a*) of the document glass platen (9) to the first lever (101), an area (B) from the first lever (101) to the second lever (102) and an area (C) from the second lever (102) to the rear edge portion (90*b*) of the document glass platen (9), and as developing colors, the areas (A) and (C) are designated in black (second developing unit) and the area (B) in colors (first developing unit) other than black. When colors are to be designated from the front edge of a document, the first lever (101) may be moved to the head position.

While, a reed switch (110) provided on the scanner (40) in the optical system (3) detects the magnets (101*a*), (102a) and outputs its signal to a control unit shown in FIG. 7 to be described later.

When the colors are to be switched at three or more locations, the corresponding number of levers may be provided.

(c) Operation Panel

Figure 6:
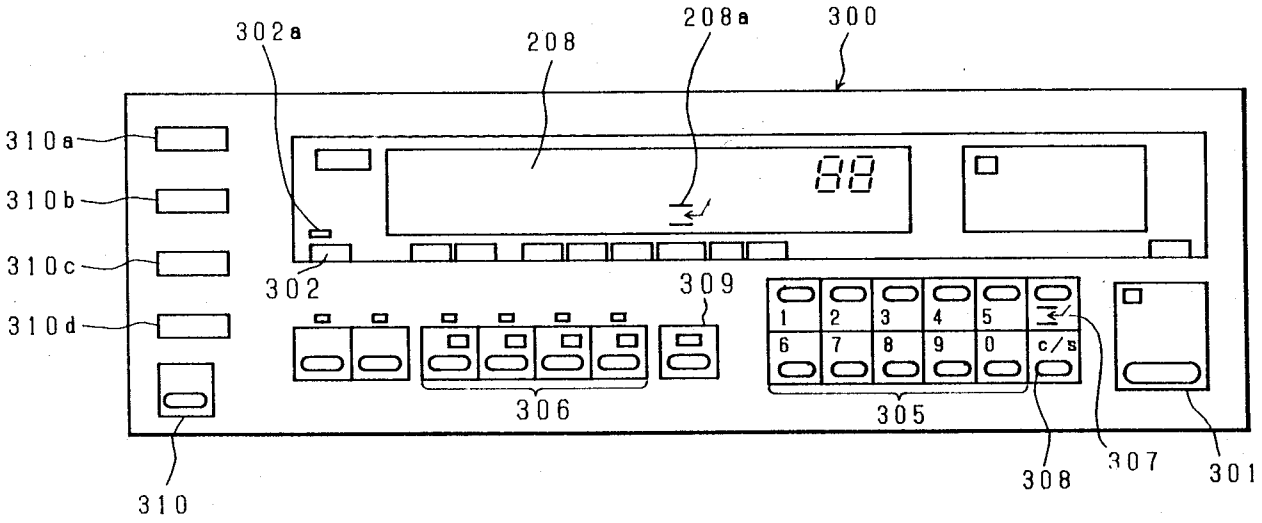
FIG. 6 is a plan view showing an operation panel.

FIG. 6 is a plan view showing the configuration of an operation panel (300). On the operation panel (300), a print key (301), display (208) for displaying the number of copies and interrupt display LED (208a) etc., ten key (305), interrupt key (307), clear/stop key (308), simultaneous two-color mode select key (hereinafter referred to as select key) (302) and its display LED (302a), fixed magnification select key (306), paper feed inlet select key (309), color select key (310), color displays (310a) through (310d) for displaying selected colors and so on are disposed.

(d) Control Circuit

Figure 7:
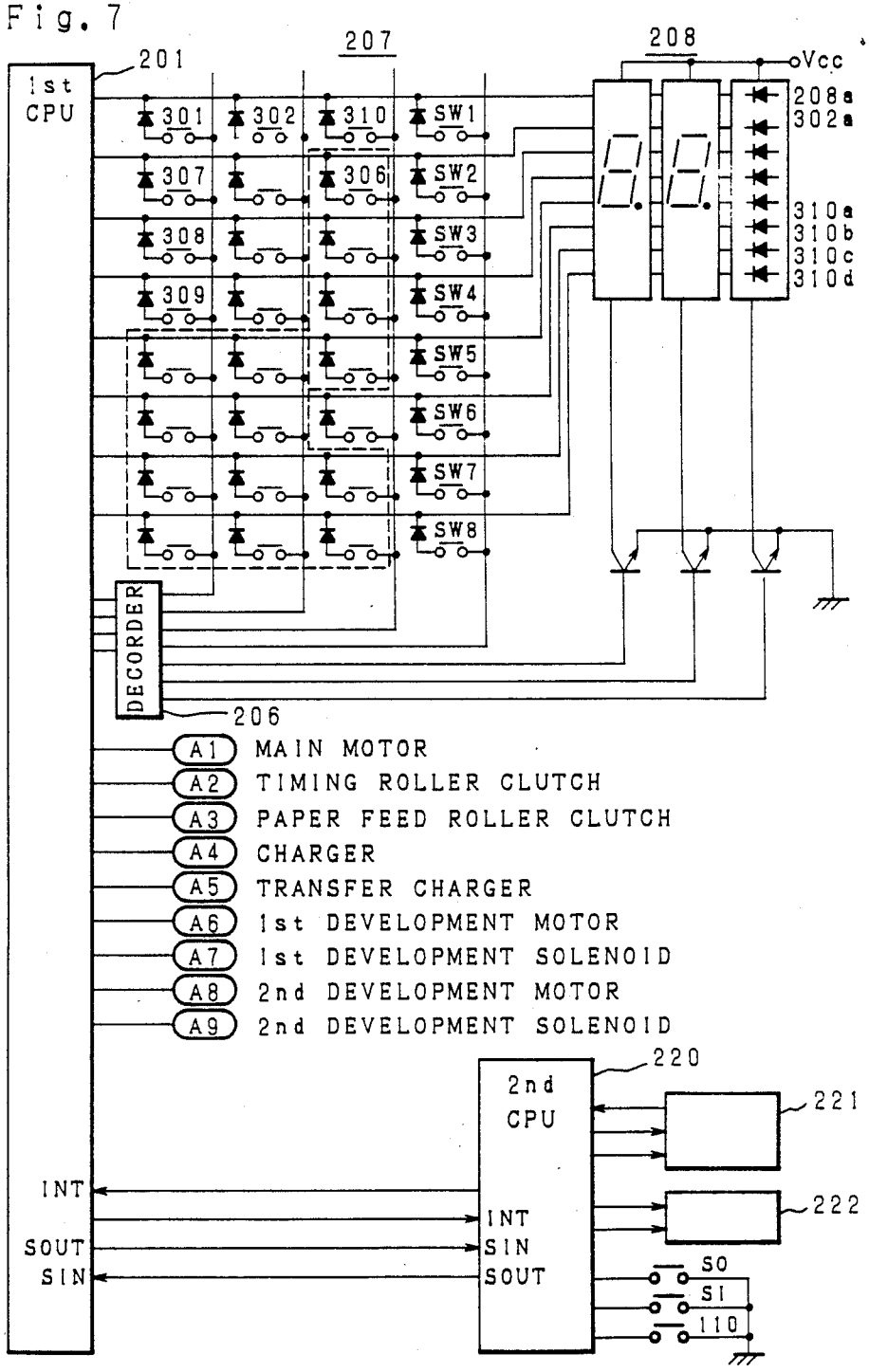
FIG. 7 is a circuit diagram showing the configuration of a control portion of a copying machine.

FIG. 7 is a circuit diagram showing the configuration of a control portion. The control portion of the copying machine having the configuration aforementioned, as shown in FIG. 7, comprises a first CPU (201) as the center, a second CPU (220) for controlling the optical system (3) and a RAM (203). The CPU (201) and CPU (220) are one-chip microcomputers which are interconnected in synchronism with each other.

To the first CPU (201), a switch matrix (207) wherein various keys, developing units detecting switches (SW1),(SW2), switches (SW3) through (SW8) for detecting toner colors and so on on the operation panel (300) are arranged crosswise is connected, and through this matrix (207) and a decoder (206), display (208), display LEDs (208a), (302a) etc. are connected. To output terminals (A1) through (A9) of the first CPU (201), a main motor, various clutches, first and second development motors, solenoids (24, 33, 24', 33') etc. are connected, and turned ON and OFF in response to signals from the switch matrix (207) and so on.

While, to the second CPU (220), a driving control portion (221) of a scanning motor, a driving control portion (222) of a stepping motor for moving a lens, a fixed position switch (SO) turned ON and OFF by the scanner (40), a timing switch (SI) and a reed switch (110) installed on the scanner (40) and so on are connected.

(e) Simultaneous Two-color Mode

Figure 8:
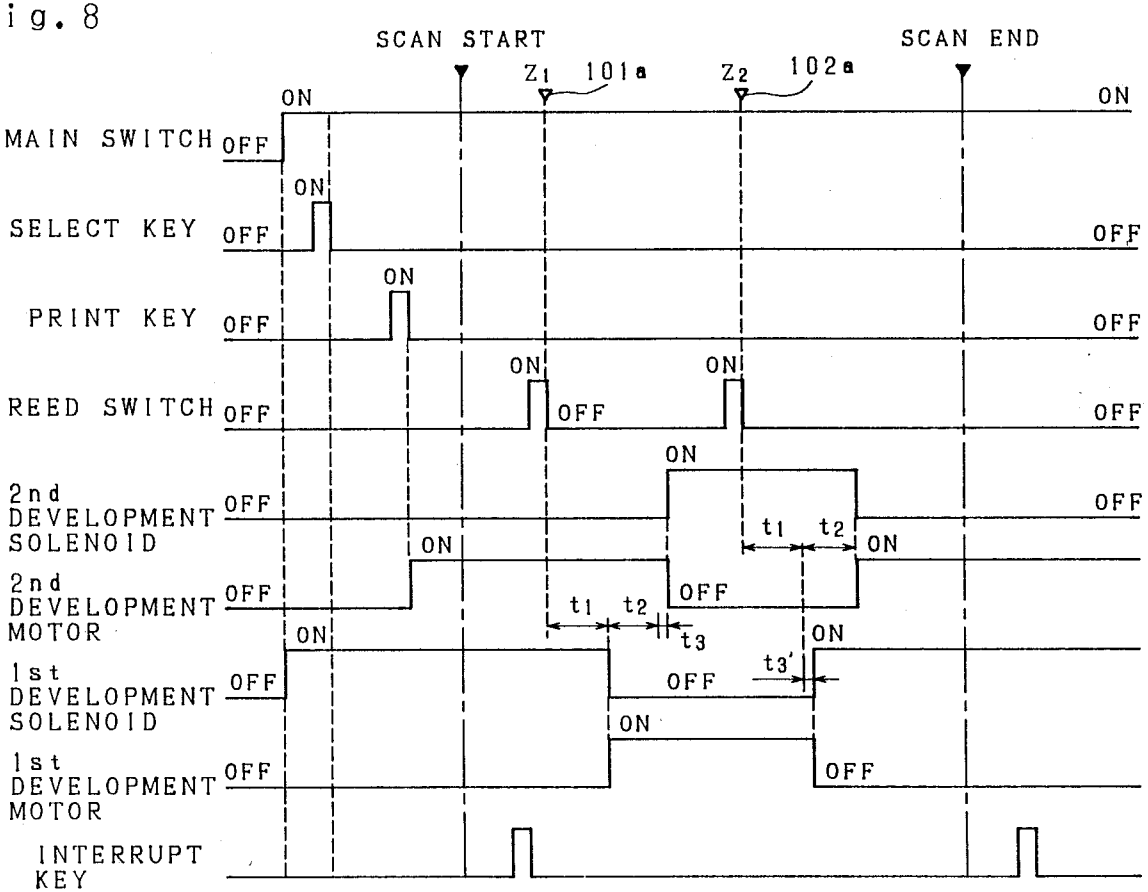
FIG. 8 is a timing chart showing simultaneous two-color copying operation.
Figure 9:
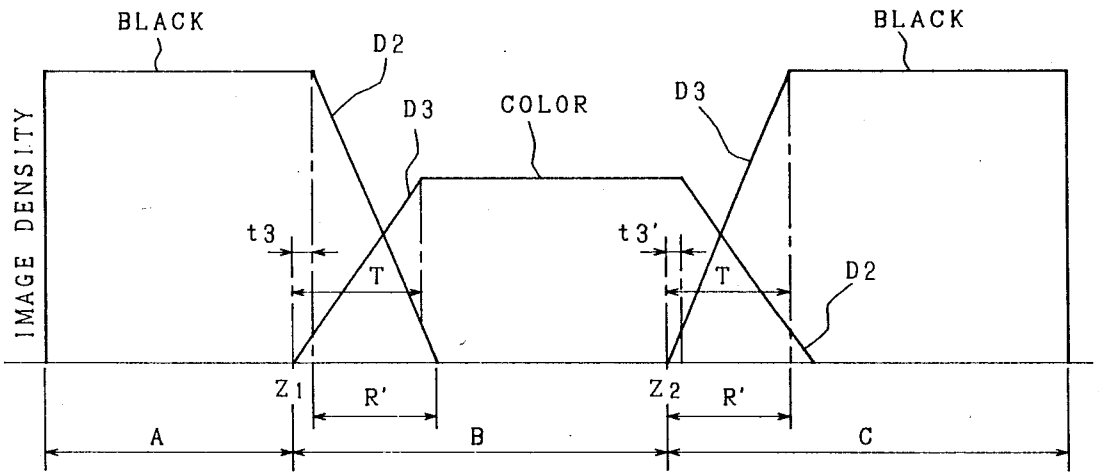
FIG. 9 is a graph showing changes of an image density on a copying machine in simultaneous two-color copying.

Now, a simultaneous two-color mode will be explained with reference to a timing chart shown in FIG. 8. FIG. 9 is a view showing changing conditions of the image density on copied paper. Timing is set so as to eliminate aberration of the image at its border and to minimize the mixed-color width.

First, when a main switch (not shown) of a copying machine is turned ON and the power is applied, as shown in FIG. 3, in the first developing unit (4), the solenoid (33) operates and the midway portion between the magnetic poles (N1) and (S1) opposes to the photosensitive drum (1), and in the second developing unit (5), the magnetic pole (N1) opposes to the photosensitive drum (1).

If the print key (301) is pressed in this state, the second developing unit (5) usually containing the black toner automatically is driven and normal copying operation is executed, but if the select key (302) is pressed before pressing the print key (301), the copying mode is changed into a state wherein simultaneous two-color copying is executable from usual copying. However, the two-color image forming mode is not executed even the select key (302) is pressed during the copying operation. If the first and second developing units (4),(5) are not set at respective predetermined positions, selection of the simultaneous two-color mode by the select key (302) can not be accepted.

Next, as shown in FIG. 4, the first and second levers (101),(102) are slid along the slide groove (103) to designate areas (A),(C) for black-and-white copying and an area (B) for color copying. The levers (101),(102) function effectively only when the two-color image forming mode is selected.

As shown in FIG. 4, when the document (D) is placed upon the document glass platen (9) and the print key (301) is turned ON in the state aforementioned, the second development motor (24') is started, the black toner is sent successively to the developing area (X') so as to be contacted to the photosensitive drum (1) in a constant width, whereby electrostatic latent image formed thereon can be developed.

Then, after the scanner (40) has started to operate in the arrow (S) direction in response to ON operation of the print key (301), the electrostatic latent image of the document (D) placed on the document glass platen (9) is, first, developed by the second developing unit (5).

Thereafter, as shown in FIG. 5, if the magnet (101a) of the first lever (101) is detected by the reed switch (110) of the scanner (40), the reed switch (110) outputs its signal to the second CPU (220).

At this point of time, the electrostatic latent image corresponding to a border portion (Z1) between the areas (A) and (B) where black switches over to color, is positioned at an exposure point (W) on the photosensitive drum (1). Until the time (t1) during which the border portion (Z1) moves between the positions from the exposure point (W) to the developing area (X) of the first developing unit (4), only the second developing unit (5) moves continuously.

When the border portion (Z1) of the electrostatic latent image reaches the developing area (X) after the time (t1) from ON operation of the reed switch (110), the first development motor (24) is turned ON and the first developing unit solenoid (33) is turned OFF. Thereby, supply operation of the color toner to the elecrostatic latent image corresponding to the area (B) is started by the first developing unit (4).

However, at the time point where the first developing unit (4) starts, in the electrostatic latent image positioned in the developing area (X), the one positioned on the upstream side in the rotating direction of the photosensitive drum (1) and that positioned on the downstream side differ in contacting time with the magnetic brush.

Accordingly, as shown in FIG. 9, the image density of the front edge of the area (B) moves gradually toward the stable state through a developing rising area (D3).

Then, after the time (t2) from start of the first development motor (24), the border portion (Z1) of the electrostatic latent image reaches the developing area (X') of the second developing unit (5) from the developing area (X).

However, at this point of time, the development motor (24') and solenoid (33') of the second developing unit (5) do not change the operating state immediately, but stop after delaying by the time (t3) still therefrom, and developing operation of the area (A) by the black toner is completed.

As shown in FIG. 9, since the electrostatic latent image of the photosensitive drum (1) contacts to the developer in a constant width, the black toner image density falls gradually through a developing falling area (D2).

As shown in FIG. 9, the time (t3) is suitably set in a developing rise time (T) from starting operation of the first developing unit (4) till the toner image density formed on the photosensitive drum (1) becomes stable.

When the scanner (40) moves further and reaches the position of the second lever (102) or the border portion (Z2) between the areas (B) and (C), the reed switch (110) detects the magnet (102*a*) and is turned ON again and outputs its signal to the second CPU (220). At this time, the electrostatic latent image corresponding to the border portion (Z2) is positioned at the exposure point (W).

After the time (t1) from ON operation of the reed switch (110), the electrostatic latent image of the border portion (Z2) reaches the developing area (X).

However, the development motor (24) and solenoid (33) of the first developing unit (4) do not change the operating state, but after delaying by the time (t3') thereafter the first development motor (24) is turned OFF and the first developing unit solenoid (33) is turned ON and color development of the area (B) is completed. The time (t3') is suitably set in the developing rise time (T) from starting operation of the second developing unit (5) till the toner image density formed on the photosensitive drum (1) by the first developing unit (4) becomes stable, and is similarly to the time (t3).

Thereby, as shown in FIG. 9, even from the border portion (Z2) on, developing is performed by the color toner for the time (t3') and thereafter, the image density falls in the developing falling area (D2).

Furthermore, after the time (t1+t2) from ON operation of the reed switch (110), namely, when the border portion (Z2) of the electrostatic latent image positioned in the developing area (X) reaches the developing area (X') of the second developing unit (5), the second development motor (24') is turned ON and the second developing unit solenoid (33') is turned OFF to start black development of the area (C). The black toner image density of the area (C) becomes stable gradually through the developing rising area (D3).

Developing operation of the second developing unit (5) is maintained till the completion of scanning and development of the area (C) is completed.

If the select key (302) is pressed and the simultaneous two-color copying mode is selected, as to be described specifically in the following, key input of the interrupt copying (307) can not be accepted.

By operations aforementioned, from start to end of the scanning, developing colors are switched over from black (A) to color (B) or further to black (C) to obtain the two-color composite copy.

(f) Copying Machine Control Flow

Figure 10:
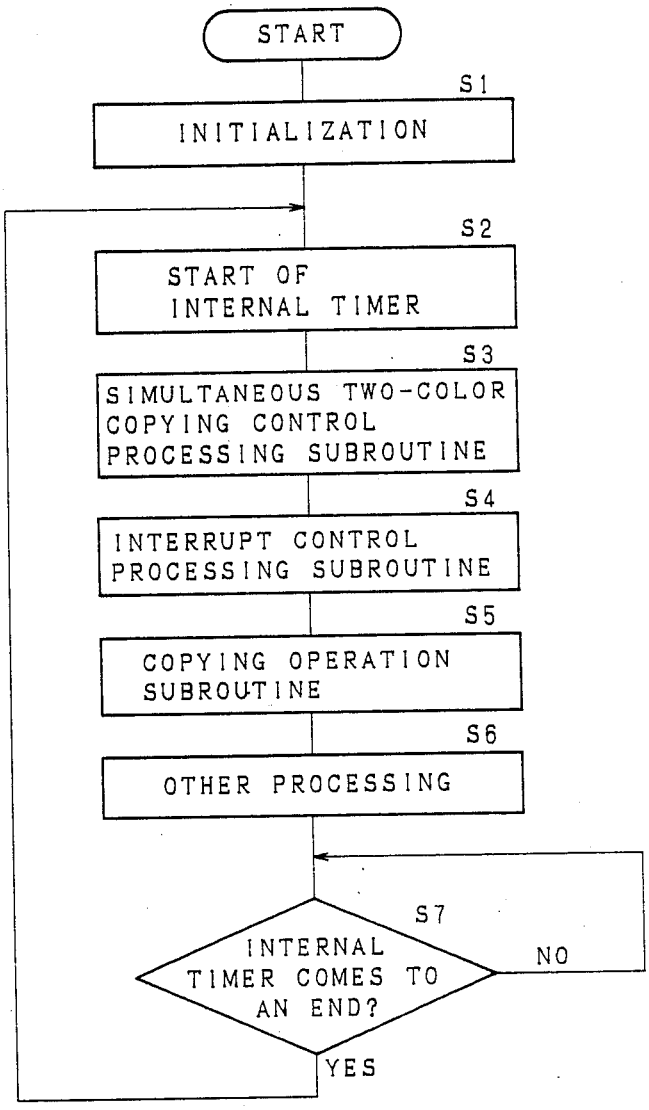
FIG. 10 is a flow chart of copying machine control.

FIG. 10 shows a schematic flow chart of a first CPU (201).

Before referring to the flow chart, terminologies ON-EDGE and OFF-EDGE used therein will be defined.

ON-EDGE is defined as the change of state wherein the states of switch, sensor, signal, etc. have changed from OFF to ON.

While, OFF-EDGE is defined as the change of state wherein the states of switch, sensor, signal etc. have changed from ON to OFF.

When the first CPU (201) is reset and a program is started, the first CPU (201) is initialized to clear a RAM and to set various registers and so on, and an apparatus is set in its initial mode (Step S1).

Then, an internal timer incorporated in the first CPU (201) and whose value is set in advance at initial setting is started (Step S2).

Thereafter, subroutines of simultaneous two-color copying control processings interrupt control processings, copying operation processings and other processings (Steps S3 through S6) are called successively, and when all subroutine processings all completed, after completion of the internal timer set at the start (Step S7), one routine is completed. Using the length of time of one routine, various timers appeared during respective subroutines are counted (various timers determined completion of respective timers by the number of counts for one routine).

Figure 11:
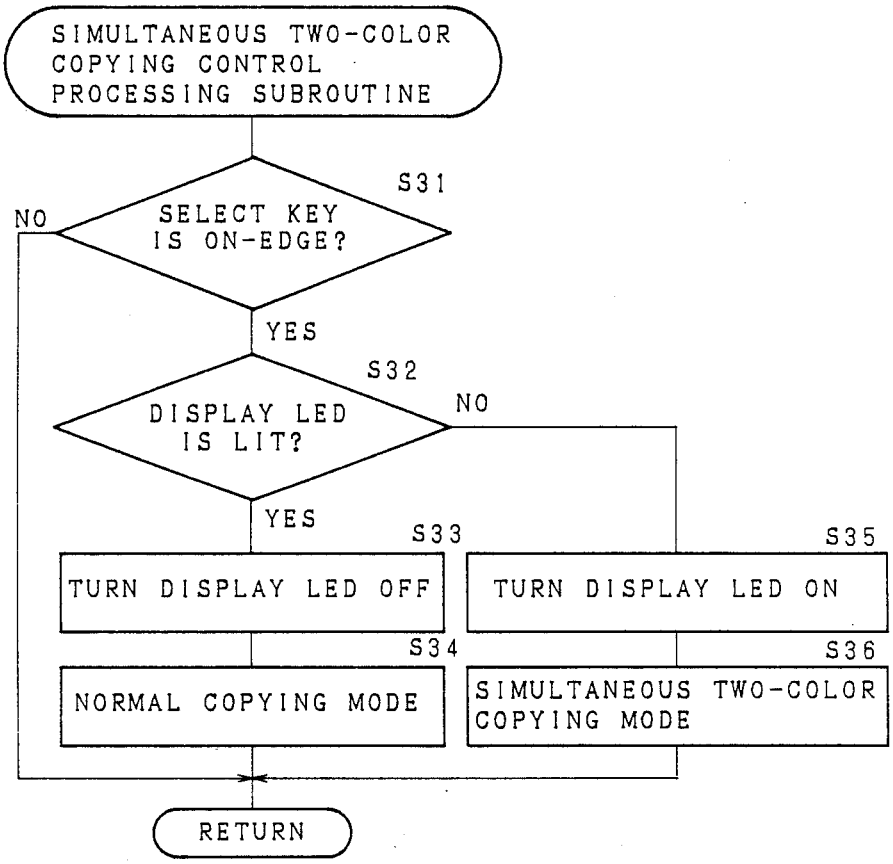
FIG. 11 is a flow chart of simultaneous two-color control.

FIG. 11 shows a flow chart of a simultaneous two-color copying control processing subroutine (Step S3). By ON-EDGE of a select key (302)(Step S31), if a display LED (302*a*) is lit (Step S32), the CPU (201) turns it OFF (Step S33) and sets a normal copying mode (Step S34). If the display LED (302*a*) is not lit in S32, the CPU (201) turns it on (Step S35) and sets a simultaneous two-color copying mode (Step S36).

Figure 12:
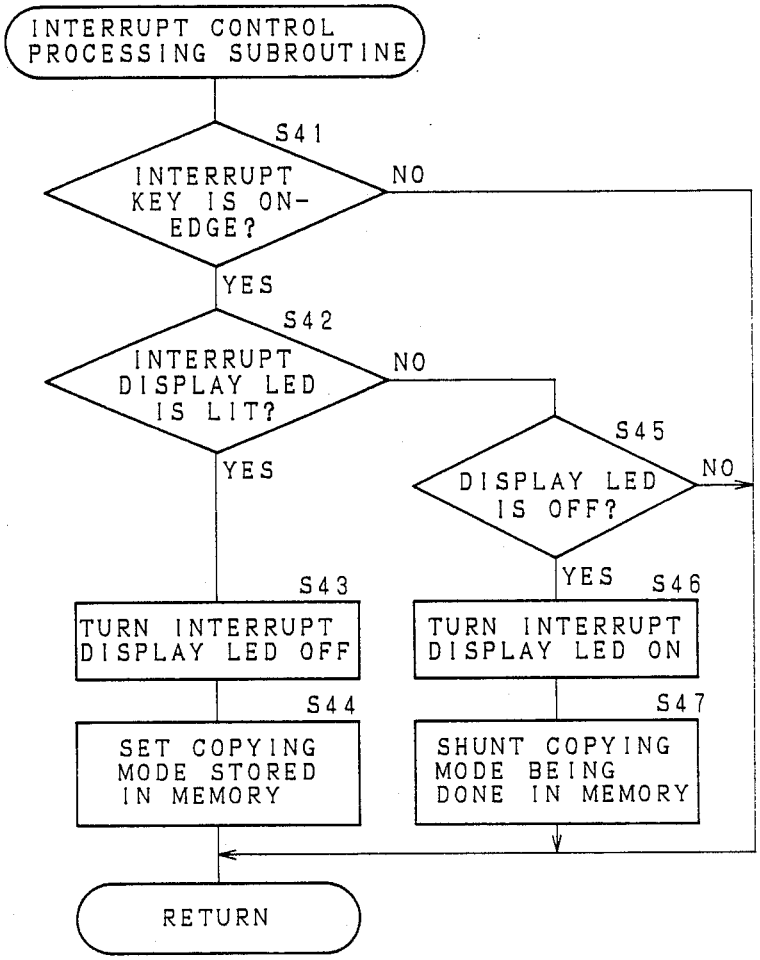
FIG. 12 is a flow chart of interrupt copying control.

FIG. 12 shows a flow chart of an interrupt control processing subroutine (Step S4).

By ON-EDGE of an interrupt key (307) (Step S41), if a display LED (208*a*) is lit (Step S42), the CPU (201) turns it OFF (Step S43) and sets a copying mode (the number of copies, magnification, color etc.) stored in a memory (Step S44).

If the display LED (208*a*) is not lit in step S42, the CPU (201) proceeds to Step S45 and determines whether or not the display LED (302*a*) us OFF, or the simultaneous two-color copying mode is selected, if the simultaneous two-color copying mode is not selected, the CPU (201) turns ON the interrupt display LED (208*a*) (Step S46) and shunts the copying mode (the number of copies, magnification, color etc.) set at present into the memory (Step S47). If the display LED (302*a*) is lit in Step S45, namely, of the simultaneous two-color copying mode is selected, the CPU (201) returns without doing anything. That is, when the simultaneous two-color copying mode is selected, even if the interrupt key 307 is operated, interruption is not accepted.

In the present embodiment though the border position and developing colors in simultaneous two-color copying mode are designated by the levers (101),(102), also in the other method such as the method of storing these data in the memory, when its content can be rewritten during interruption, miscopying can be prevented if the interruption is prohibited during the simultaneous two-color mode copying in the same way as the present embodiment.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An image forming apparatus comprising, a movable electrostatic latent image carrier:

image processing means, while scanning a document with relative motion between said document and lighting means, for irradiating light to said document to form an electrostatic latent image on said electrostatic latent image carrier by exposing an image of said document;

image editing means for dividing said document into plural areas in the scanning direction of said image processing means to designate a developing color for each of said divided area;

a plurality of developing means disposed in the moving direction of said electrostatic latent image carrier and containing developers having respectively different colors;

simultaneous multicolor copy designating means for designating simultaneous multicolor copying;

control means, when the simultaneous multicolor copying designated by said simultaneous multicolor copy designating means, for operating and stopping respective developing means during one scanning operation of said image processing means to supply the developers having designated developing color respectively to the electrostatic latent image opposing to the area divided by said image editing means;

interrupt copy designating means for designating and releasing interrupt copying which performs, during copying of a document, copying of a document different therefrom;

interrupt copying control means, when interrupt copying is designated by said interrupt copy designating means, for storing the present copying mode so as to return to that mode when the interrupt copying is released; and designation prohibiting means for prohibiting designation by said interrupt copy control means, when the simultaneous multicolor copying is designated by said simultaneous multicolor copy designating means.

2. An image forming apparatus as set forth in claim 1, wherein said image editing means comprises, an indicating member being movable in the scanning direction of said image processing means, and means, for detecting the position of said indicating member to divide the area of said document according to the detected position.

3. An image forming apparatus comprising, a movable electrostatic latent image carrier;

a platen for placing a document thereon;

image processing means having scanning means for scanning the document placed on said platen by moving relative to said platen, and forming an image of said document on said electrostatic latent image carrier;

dividing means, provided on the side portion of said platen and having an indicating member movable in the scanning direction of said image processing means by manual operation, for dividing the document area on said platen in said scanning direction;

detecting means, provided on said scanning means, for detecting the position of said indicating member by relative movement of said scanning means;

a plurality of developing means, disposed along the moving direction of said electrostatic latent image carrier and containing developers having respectively different colors;

simultaneous multicolor copy designating means for designating simultaneous multicolor copying;

control means, when simultaneous multicolor copying is designated by said simultaneous multicolor copy designating means, for operating and stopping respective developing means in response to the detected signal from said detecting means while said scanning means reciprocates once, to supply the developers having designated developing color respectively to the electrostatic latent image opposing to the area divided by said indicating members;

interrupt copy designating means for designating and releasing the interrupt copying which performs, during copying of a document, copying of a document different therefrom;

interrupt copying control means, when interrupt copying is designated by said interrupt copy designating means, for storing the present copying mode so as to return to that mode when the interrupt copying is released; and designation prohibiting means for prohibiting designation by said interrupt copying control means, when the simultaneous multicolor copying is designated by said simultaneous multicolor designating means.

4. An image forming apparatus comprising, an indicating member, being movable manually, for designating the document image area;

distinguishing means for distinguishing the area designated by said indicating member;

edition designating means for designating edit copying which edits an image in the distinguished area;

means for performing edit copying for a document image designated by said indicating member on the basis of the distinguished result from said distinguishing means, when edit copying is designated by sade edit designating means;

interrupt copy designating means for designating and releasing interrupt copying which performs, during copying of a document, copying of a document different therefrom;

interrupt copying control means, when interrupt copying is designated by said interrupt copy designating means, for storing the present copying mode so as to return to that mode when the interrupt copying is released; and designation prohibiting means for prohibiting designation by said interrupt copying control means, when edit copying is designated by said edit copying designating means.

* * * * *